US005799813A

United States Patent [19]

Letica

[11] Patent Number: 5,799,813

[45] Date of Patent: Sep. 1, 1998

[54] PLUG CLOSURE WITH INTEGRAL PULL RING

[75] Inventor: Anton I. Letica, Rochester Hills, Mich.

[73] Assignee: Letica Corporation, Rochester, Mich.

[21] Appl. No.: 619,141

[22] Filed: Mar. 25, 1996

[51] Int. Cl.[6] ..... B65D 51/18

[52] U.S. Cl. ..... 220/254; 222/541.6; 222/541.9; 222/563; 229/160.2; 220/255; 220/789; 220/791; 220/801; 220/601

[58] Field of Search ..... 229/160.2; 215/250, 215/255, 256, 294, 295, 296, 298, 305, 355, 363; 222/541.1, 541.5, 541.9, 554, 556, 557, 562, 563; 220/DIG. 19, 601, 160, 789, 787, 790–793, 254, 255, 265, 266, 276, 780, 796, 801, 805; 217/110, 111

[56] References Cited

U.S. PATENT DOCUMENTS

| | | | |
|---|---|---|---|
| 1,022,074 | 4/1912 | Graham | 220/789 |
| 2,533,355 | 3/1950 | Comfort . | |
| 3,289,881 | 12/1966 | Ganung | 220/254 |
| 3,608,771 | 9/1971 | Monroe et al. | 220/266 |
| 3,750,820 | 8/1973 | Labarre | 215/296 X |
| 3,923,195 | 12/1975 | Wallace | 220/789 |
| 4,000,839 | 1/1977 | Tecco et al. | 220/254 X |
| 4,076,141 | 2/1978 | Lewis | 215/254 |
| 4,105,141 | 8/1978 | Lane et al. | 222/563 X |
| 4,320,843 | 3/1982 | Dubach | 215/256 |
| 4,441,662 | 4/1984 | Von Holdt | 220/254 X |
| 4,442,949 | 4/1984 | Dwinell et al. | 222/541.9 X |
| 4,449,640 | 5/1984 | Finkelstein | 220/254 X |
| 4,534,481 | 8/1985 | Summers et al.j | 215/256 X |
| 4,609,121 | 9/1986 | Ludwig | 220/791 X |
| 4,632,282 | 12/1986 | Nagashima | 220/270 X |
| 5,103,993 | 4/1992 | Bingisser | 220/792 X |
| 5,199,618 | 4/1993 | Reil et al. . | |
| 5,251,770 | 10/1993 | Bartley et al. | 215/305 X |

FOREIGN PATENT DOCUMENTS

| | | | |
|---|---|---|---|
| 803154 | 10/1958 | United Kingdom | 220/260 |
| 1444028 | 7/1976 | United Kingdom . | |
| 1444451 | 7/1976 | United Kingdom | 222/541.5 |

*Primary Examiner*—Allan N. Shoap
*Assistant Examiner*—Robin A. Hylton
*Attorney, Agent, or Firm*—Young & Basile, P.C.

[57] ABSTRACT

A removable plug for use in combination with a planar closure having an aperture formed therein. The plug body is of shallow cylindrical configuration and has a top flange which is partially subdivided into inner and outer ring portions by a combination of weak frangible links and strong non-frangible links. A tab integral with the outer ring portion overlies a ledge ring on the closure body to facilitate initialization of the removal process. Location of the pull ring around the maximum diameter of the top flange maximizes leverage and provides a large ring capable of accommodating several fingers of one's hand.

2 Claims, 2 Drawing Sheets

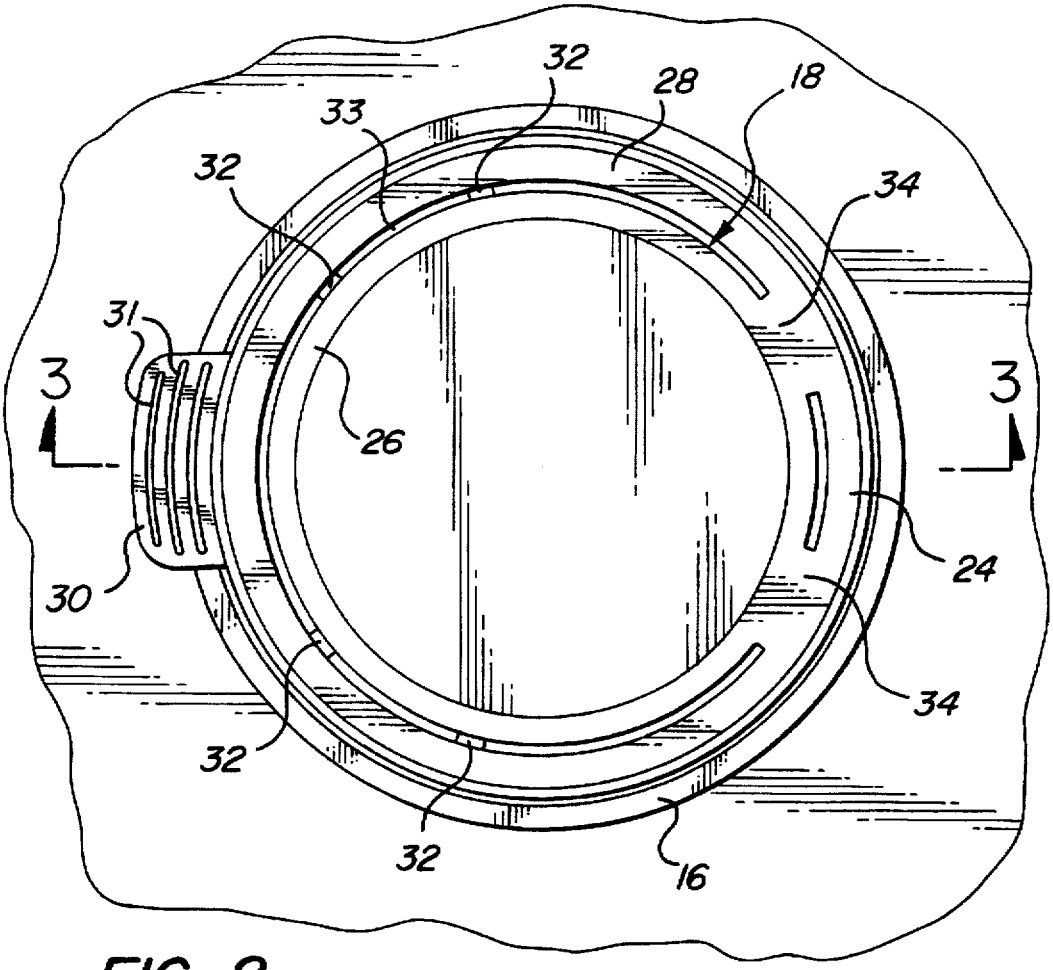
FIG-2
FIG-3
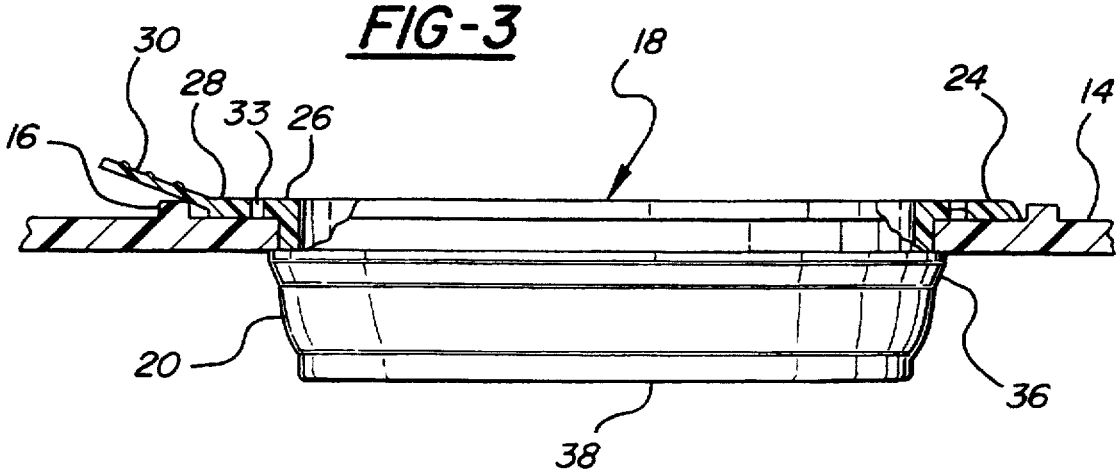

PLUG CLOSURE WITH INTEGRAL PULL RING

FIELD OF THE INVENTION

This invention relates to closures for industrial shipping containers and more particularly to a plug for removable disposition in an aperture in the body of such a closure, said plug having an integral pull ring to facilitate removal thereof from the closure aperture.

BACKGROUND OF THE INVENTION

Industrial shipping containers having tamper resistant closures are in widespread use in the United States and in other countries. One such container, manufactured in sizes from 1 to 6 gallons, comprises an open end pail and a molded plastic closure or lid having an inverted U-shaped peripheral channel which receives the rim of the open end of the pail and is secured thereto in such a way as to resist manual removal with anything less than considerable force and/or tools to break the skirt of the closure.

It is known to provide apertures in the thin planar central portion of the closure and to provide a molded plastic plug which seals the aperture during normal use of the pail/closure combination but which is removable by means of an integral pull ring for any of several purposes; e.g., to permit the introduction of additives such as pigments to material in the container.

One such plug comprises a shallow cylindrical body having a side wall, a bottom, and a small top flange. Molded integrally with the and at the floor of the recess formed by the side wall is a pull ring which can be engaged by a single finger of one's hand and lifted to disengage the plug from the closure aperture. Because the pull ring lies within the plug recess, its diameter is less than that of the top flange.

SUMMARY OF THE INVENTION

The present invention provides a plug for closure apertures in which manual engagement and operation of the pull ring to remove the plug from the closure aperture is greatly facilitated and which is of such simplified design as to reduce the complexity and cost of tooling which is required to manufacture the plug.

In general, this is accomplished in a plug design characterized by a shallow cylindrical configuration including a side wall, a bottom, and a relatively large radially extending top flange, the top flange being at least partially subdivided over a substantial circumferential portion thereof into radially separate inner and outer ring portions, the outer ring portion forming a relatively large diameter pull ring which can be separated partially from the inner ring and thereafter grasped by two or more fingers of one hand for the purpose of separating the plug body from the closure aperture.

In the preferred form hereinafter described in detail, the top flange of the plug body is subdivided into inner and outer ring portions, the outer ring portion being integrated with the inner ring portion over a substantial circumferential portion by thin section, frangible links and, at the circumferentially minor portion by one or more thicker, non-frangible portions. In addition, the major outer ring portion is provided with a radially extending tab which cooperates with a ledge ring molded around and in spaced relation to the aperture on the top surface of the closure body so as to lift and position the tab for grasping by one's hand.

In operation the preferred embodiment of the invention is easily put into operation by lifting the pull tab and separating the frangible links of the pull ring from the inner portion of the top flange until only the thicker non-frangible link or links diametrically opposite the lifting tab remain. At this point several fingers of one's hand are inserted into and through the pull ring and the pull ring is relatively easily separated from the closure body as a result of the maximum leverage produced by having the pull ring lift point at a maximal radial spacing relative to the center of the plug.

BRIEF OF THE DRAWINGS

FIG. 2 is a plan view of the pull ring plug in the closure aperture; and

FIG. 3 is a side view partly in section of the plug of FIGS. 1 and 2 in the closure aperture prior to initiation of the removal procedure.

DETAILED DESCRIPTION OF THE SPECIFIC EMBODIMENT

Figure 1:
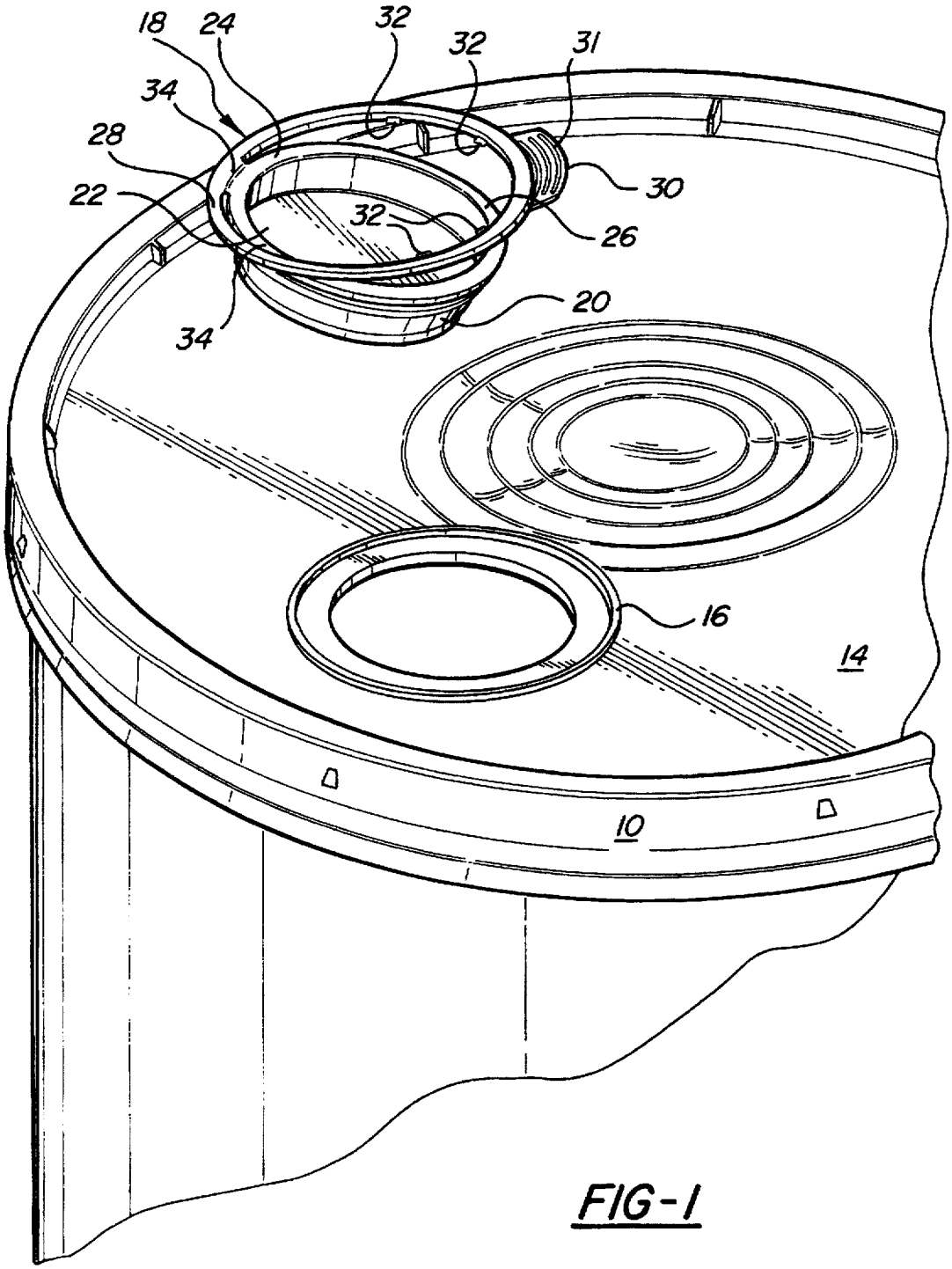
FIG. 1 is a perspective view, partly exploded, of an industrial shipping container having a pull ring plug in a closure aperture in accordance with the present invention.

Referring to FIG. 1 there is shown an injection molded polyethylene industrial container comprising a closure 10 and a five gallon pail 12 which is suitable for a variety of industrial storage and shipping applications. The size and material are exemplary only. The closure 10 has an outer peripheral inverted U-shaped channel portion 13 adapted to fit over and "lock" securely to the rim of the pail 12 in a well known tamper resistant fashion. Closure 10 exhibits a relatively large, thin section, planar central portion 14 having formed therein an aperture 15 of approximately two inch diameter and, in radially spaced relationship to the aperture 15, an integrally molded raised ring 16 of approximately ⅛th inch in radial dimension and 3/32nds of an inch in height.

Adapted for removable disposition within the aperture 15 is a plug 18 of molded plastic construction having a tapered side wall 20, a bottom 22, and a radially extending top flange 24. The top flange is subdivided in the manufacturing operation into radially spaced inner and outer rings 26 and 28, respectively. As seen in FIG. 1 through 3, the inner and outer rings 26 and 28 respectively are annularly spaced from each other by a thin through annular slit 33. The slit 33 extends well over one-half around the periphery of the inner ring 26 to define the inner and outer rings 26 and 28 respectively. The outer ring portion 28, as hereinafter explained, forms a large diameter pull ring having a lifting tab 30 with ridges 31 on the upper surface thereof.

The physical association between the inner and outer ring portions of the top flange 24 comprises a plurality of circumferentially spaced thin section frangible links 32 and, essentially diametrically opposite the lifting tab 30, one or more thick section, non-frangible links 34. The thin section links 32 are designed to be rupturable so as to separate the pull ring portion 28 from the remaining inner ring 26 whereas the non-frangible sections 34 remain intact and provide the area at which the pulling force is applied for purposes of removing the plug 18 from the aperture 15 in the closure 10.

As best shown in FIGS. 2 and 3, the plug 18 is manufactured and installed with all of the links 32 and 34 integral; i.e., unruptured, the dimensions of the plug and the ledge ring 16 being such that the plug fits snugly within the aperture 15 and is locked in place by means of the tapered side wall 20 and the locking ridge or ring 36 which is apparent in FIG. 3. The plug 18 also exhibits a slight recess 38 in the bottom exterior.

The outer ring portion of the top flange lies wholly within the confines of the ledge ring 16. However, the pull tab 30 is of greater diameter than that of the ledge ring 16 and overlies the ledge ring as shown in FIG. 3. This aids the person removing the plug 18 in lifting the pull ring 28 to initiate the operation by which the pull ring 28 is separated from the top flange and plug 18 is removed from the aperture 15.

OPERATION

In operation, the plug 18 is installed in the closure 10 in the fashion shown in FIG. 3. All of the links 32 and 34 are integral; i.e., unbroken. In this condition, the plug 18 is firmly seated within the aperture 15 and seals the aperture against any leakage of the contents of the container 12.

To remove the plug, one lifts the outer peripheral portion of the tab 30 which is poised for manual contact by its association with the underlying ledge ring 16 molded integrally with the top planar portion 14 of the closure 10. The tab is lifted until the frangible links 32 of the container begin to break and the pull ring 28 is fully defined as illustrated in FIG. 1. At this point it is possible to insert two or three fingers of one's hand through the pull ring and, using the leverage which is obtained by virtue of the large radial spacing between the center of the plug 18 and the non-frangible links 34 where the pulling force is applied, the plug 18 is relatively easily separated from the closure aperture.

After the operation requiring removal of the plug 18 has been performed, the plug may be reinserted into the aperture where it again seals the container.

We claim:

1. A molded plastic closure for an industrial shipping container comprising:

a molded plastic closure body having an outer peripheral inverted U-shaped channel portion adapted to fit over an lock to the rim of a container, said closure having a planar central portion having formed therein a circular aperture and integrally molded, raised ring surrounding and in radially spaced relation to said aperture, a section of said closure surrounding said aperture and being between said aperture and said raised ring, said section and said central portion being in the same plane; and a molded plastic plug body removably disposed in said aperture in snug sealing relationship thereto and having a shallow cylindrical portion comprising a side wall and a floor integral with said side wall, said side wall sealingly engageable with the inner edge of said closure aperture, said plug having an enlarged top flange extending radially outwardly from said side wall but fitting within the interior space defined by said closure ring, said flange being circumferentially subdivided into inner and outer ring portions by a circular slot having at least one thin frangible connector web between said inner and outer ring portions and at least one thicker non-frangible connector portion whereby said flange may be frangibly partially divided into separable ring portions;

said outer ring portion having integrally formed therewith a lifting tab which extends radially outwardly from said outer ring in overlying relationship with said raised ring so as to be maintained in a raised relationship relative to the central portion of said closure.

2. An apparatus as defined in claim 1 wherein said lifting tab has integral ribs formed thereon.

* * * * *